US008337370B2

(12) United States Patent
Rogers et al.

(10) Patent No.: US 8,337,370 B2
(45) Date of Patent: Dec. 25, 2012

(54) WEIGHTLIFTING SUPPORT ASSEMBLY

(75) Inventors: Orley David Rogers, Sanford, MI (US); Timothy John Hockemeyer, Midland, MI (US)

(73) Assignee: Rogers Athletic Company, Clare, MI (US)

( * ) Notice: Subject to any disclaimer, the term of this patent is extended or adjusted under 35 U.S.C. 154(b) by 1256 days.

(21) Appl. No.: 11/326,099

(22) Filed: Jan. 5, 2006

(65) Prior Publication Data

US 2007/0155594 A1 Jul. 5, 2007

(51) Int. Cl.
*A63B 21/078* (2006.01)
*A63B 21/06* (2006.01)

(52) U.S. Cl. ..... 482/104; 482/94

(58) Field of Classification Search ..... 482/92–94, 482/138, 142, 98–104, 106–107, 139; 248/304, 248/306, 308; 211/85.7, 60.1; *A63B 21/06*
See application file for complete search history.

(56) References Cited

U.S. PATENT DOCUMENTS

| | | | | | |
|---|---|---|---|---|---|
| 1,422,128 | A * | 7/1922 | Rager | 248/306 |
| 4,602,785 | A * | 7/1986 | Rockwell | 482/104 |
| 4,842,270 | A * | 6/1989 | Lange | 482/101 |
| 4,861,024 | A | 8/1989 | Lee | |
| 4,982,957 | A * | 1/1991 | Shields | 482/104 |
| 5,110,119 | A * | 5/1992 | Arnold | 482/93 |
| 5,123,885 | A * | 6/1992 | Shields | 482/106 |
| 5,215,510 | A | 6/1993 | Baran | |
| 5,651,758 | A * | 7/1997 | Cervantes | 482/93 |
| 5,669,859 | A | 9/1997 | Liggett et al. | |
| 6,086,519 | A * | 7/2000 | Ayton | 482/104 |
| D444,827 | S | 7/2001 | Mobley | |
| 6,605,023 | B1 | 8/2003 | Mobley | |
| 6,623,407 | B2 | 9/2003 | Novak et al. | |
| 6,623,409 | B1 | 9/2003 | Abelbeck | |
| 6,669,607 | B2 | 12/2003 | Slawinski et al. | |
| 6,893,381 | B2 * | 5/2005 | Slawinski | 482/8 |
| 7,066,866 | B1 * | 6/2006 | Mobley | 482/40 |
| 7,094,185 | B2 * | 8/2006 | Greenland | 482/100 |
| 7,338,416 | B2 * | 3/2008 | Smith | 482/104 |
| 7,455,629 | B2 * | 11/2008 | Abelbeck | 482/92 |
| 7,488,277 | B1 * | 2/2009 | Knapp | 482/104 |

* cited by examiner

*Primary Examiner* — Oren Ginsberg
(74) *Attorney, Agent, or Firm* — Carlson, Gaskey & Olds PC

(57) ABSTRACT

A weightlifting system includes a weight bar frame rack which includes a multitude of openings along an upright to receive a weight support assembly at various positions along the frame rack. The support assembly includes a multitude of studs which extend from an inner surface of a U-shaped support plate to engage the openings and provide a robust weight support which will bear a significant quantity of weight. In use, the weight support assembly is pushed into and down the upright such that that the studs engage and are guided by the openings. Concurrent therewith, a spring bias is overcome until a latch member encounters a lock opening to securely lock the support into the desired position. To remove the weight support assembly a lock trigger is retracted and the weight support assembly is lifted up and out of the openings. The entire locking and unlocking of the weight support assembly is readily performed with one hand.

36 Claims, 8 Drawing Sheets

WEIGHTLIFTING SUPPORT ASSEMBLY

BACKGROUND OF THE INVENTION

The present invention relates to weightlifting equipment, and more particularly to a support hook assembly for resting a weight bar.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. The support assembly also often operates to spot the lifter and prevent the free weight from being dropped past a particular point.

Between "sets" free weights are rested upon a support assembly which mounts to a weight bar frame rack. The support assembly is also adjustable relative to the frame rack to locate the weight at a height desired for a particular lifter. Conventional support assemblies are typically posts or hooks which engage the frame rack at one of a multitude of locations.

Although effective, conventional support assemblies typically provide a tradeoff between sturdiness, security when locked along and ease of positioning the frame rack.

Accordingly, it is desirable to provide a weight support assembly which will support a significant amount of weight, be securely lockable to the frame rack yet be readily repositioned.

SUMMARY OF THE INVENTION

A weightlifting system according to the present invention includes a weight bar frame rack and weight support assembly for attachment thereto. The weight support assembly supports a weight bar or the like. The frame rack includes a multitude of openings along an upright which receive the weight support assembly such that the support assembly may be located at various positions along the frame rack.

The openings are arranged in horizontally opposed pairs perpendicular to the longitudinal axis of the upright. A lock opening is located through the front face between each vertically separated pair of openings.

The support assembly includes support plates which extend generally perpendicularly from a central support plate to form a generally U-shape. A multitude of studs extend from an inner surface of the support plates to engage the openings and provide a robust support for a significant quantity of weight.

A pair of generally parallel hook plates extend perpendicularly from the central support plate. The hook plates define an angled intersection to receive a weight bar or the like therein. A non-metallic bumper bridges an edge surface of the hook plates to cushion impacts with the weight bar. A wear pin is mounted at the angled intersection to facilitate positioning of the weight bar thereon.

A lock trigger is pivotally mounted between the hook plates at a pivot pin. The lock trigger is biased such that a latch member extends through a latch aperture within the central support plate. The lock trigger is accessed through a trigger guard aperture formed within the hook plates.

In use, the weight support assembly is selectively attached to a desired position along the weight bar frame rack by locating the studs adjacent to openings at a desired height.

The weight support assembly is pushed toward the frame member such that that studs engage and are guided by the openings. Concurrent therewith, the lock trigger is driven away from the central support plate by interaction of the latch member with the front face of the frame member such that the bias of a spring is overcome and the latch member is retracted into the lock opening. As the studs slide toward the bottom of the openings, the latch member encounters the lock opening and the latch member engages therewith. The weight support assembly is thereby securely locked into place.

To remove the weight support assembly, the lock trigger is retracted by locating one or more fingers in the trigger guard aperture and squeezing to overcome the bias of the spring. This is readily achieved by grasping the hook plates. The weight support assembly is then lifted up and out of the openings. As the openings include corners with significant radii, the studs are readily guided thereby. Advantageously, the entire locking and unlocking of the weight support assembly is readily performed with one hand.

The present invention therefore provides a weight support assembly which will support a significant amount of weight, is securely lockable, yet is readily repositioned along the frame rack.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
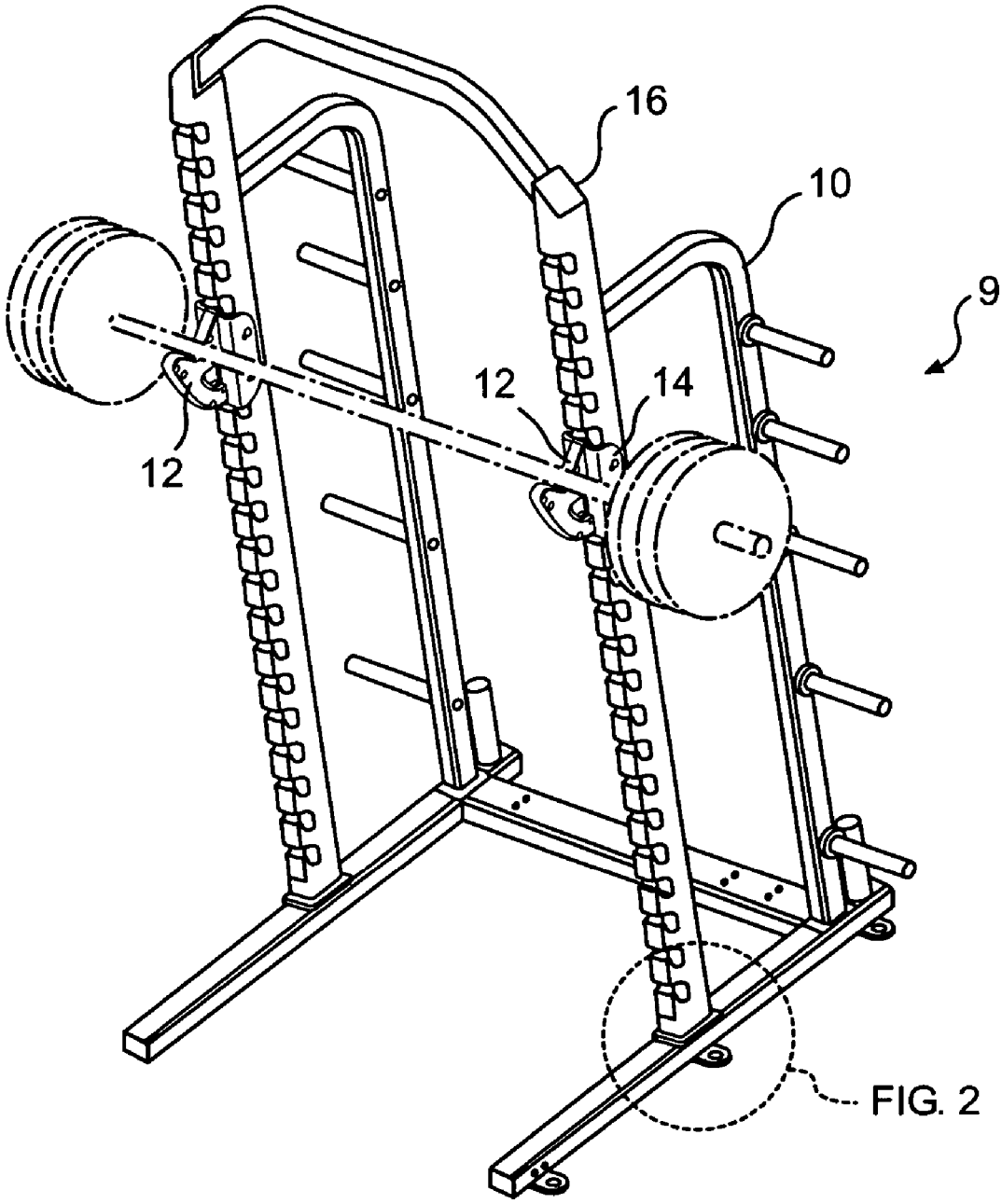
FIG. 1 is a general perspective view of a weightlifting system according to the present invention.

FIG. 1 illustrates an exploded view of a weightlifting system 9 which includes a weight bar frame rack 10 and weight support assembly 12 (two shown) for attachment thereto. It should be understood that although a particular frame arrangement is illustrated in the disclosed embodiment, other arrangements will be usable with the present invention.

The frame rack 10 includes a multitude of openings 14 along an upright frame member 16 which receive the weight support assembly 12 such that the support assembly 12 may be located at various positions along the frame rack 10. Each opening 14 is separated from the next by approximately four inches to provide significant incremental adjustment, however, any separation will be usable with the present invention.

Figure 2:
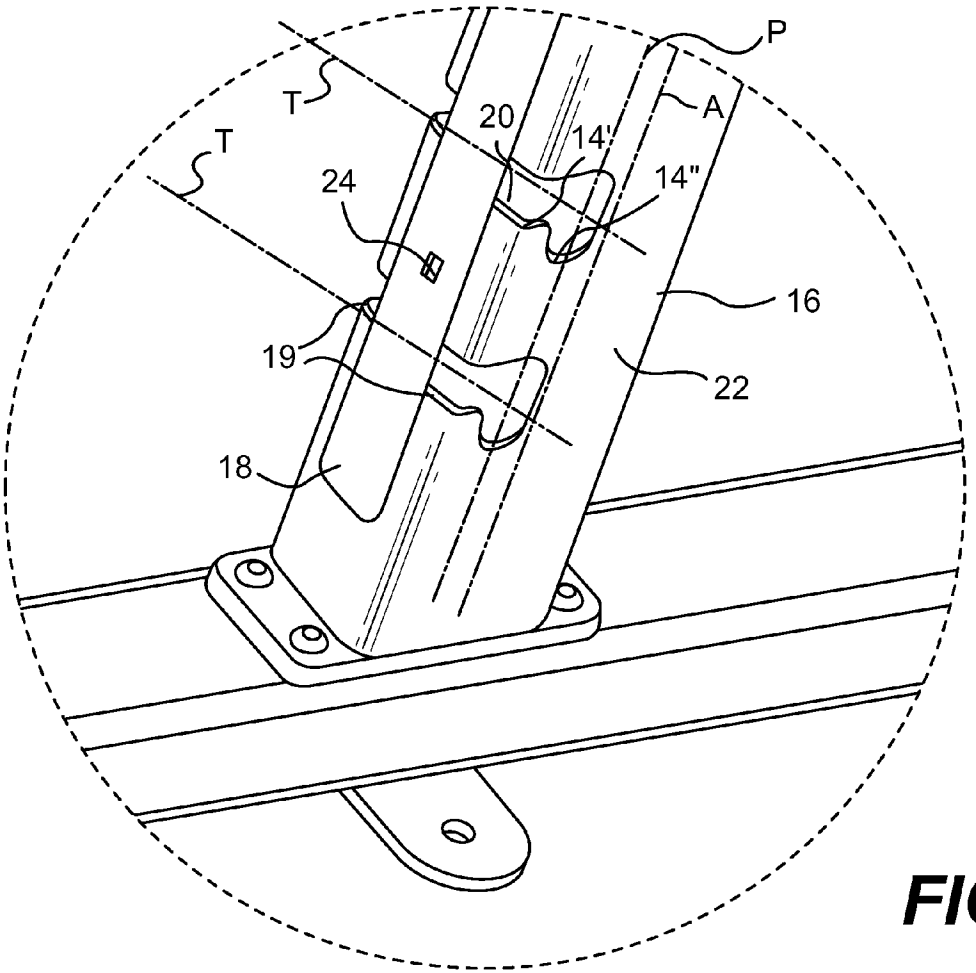
FIG. 2 is an expanded view of a weightlifting system frame rack upright.

Referring to FIG. 2, each upright frame member 16 defines a longitudinal axis A which extends vertically relative to the ground. The upright frame member 16 is generally rectilinear in shape and is preferably manufactured of tubing which is rectangular in cross-section. The upright frame member 16 includes a front face 18 and a first and second side face 20, 22.

Figure 3:
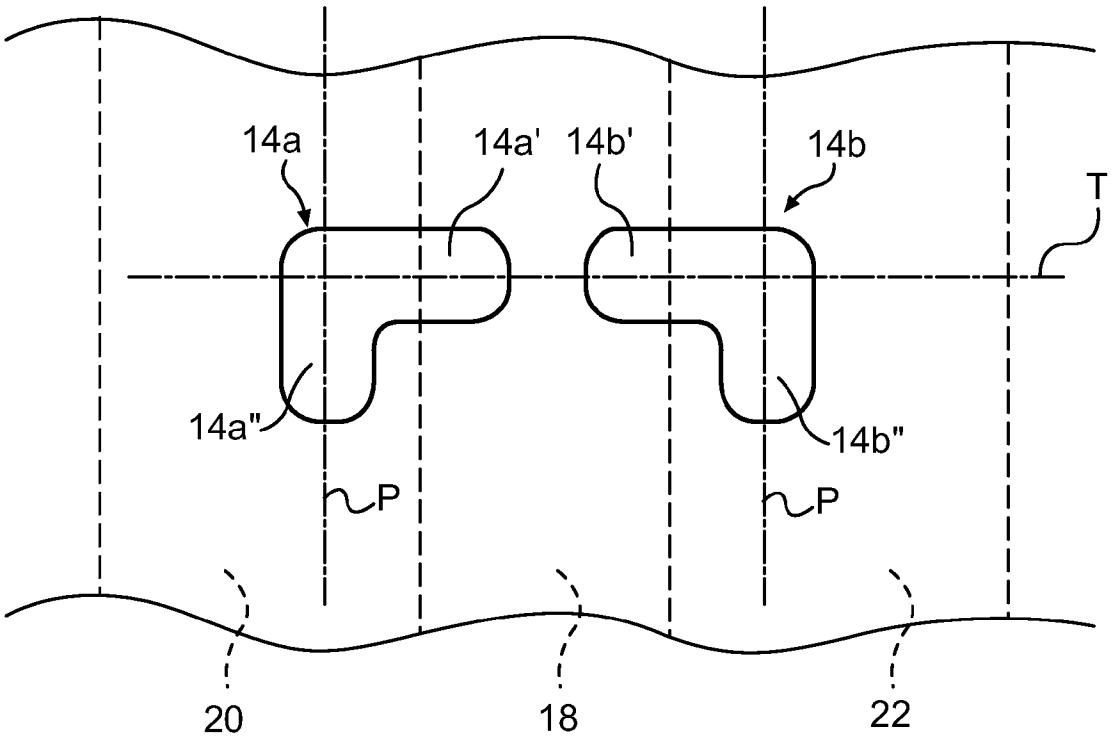
FIG. 3 is a schematic view of an opening weightlifting system frame rack upright illustrated in FIG. 2.

The upright frame member 16 includes a multiple of opposed pairs of openings 14*a*. 14*b* along the longitudinal axis A, each of the opposed pairs of openings 14*a*, 14*b* include a first opening 14*a* and a second opening 14*b*. Each opening 14 is generally L-shaped and spans the intersection of the front face 18 and one of the side faces 20, 22. In this non-limiting embodiment, the first opening 14*a* spans the front face 18 and the side face 20 and the second opening 14*b* spans the front face 18 and the side face 22. In other words, each opening 14 cuts through the corner of the upright frame member 16. Each opening 14 includes a first opening portion 14' in the front face 18 generally transverse to the longitudinal axis A along a transverse opening axis T and a second opening portion 14" through the respective side face 20, 22 generally parallel to the longitudinal axis A along a parallel opening axis P. In this non-limiting embodiment. the first opening 14*a* defines a first first opening portion 14a' through the front face 16 generally transverse to the longitudinal axis A along the transverse opening axis T and a second first opening portion 14*a*" through the first side face 20 generally parallel to the longitudinal axis A along the parallel axis P while the second opening 14*b* defines a first second opening portion 14*b*' through the front face 16 generally transverse to the longitudinal axis A along the transverse opening axis T and a second second opening portion 14*b*" through the second side face 22 generally parallel to the longitudinal axis A along the parallel axis P. That is, the portions 14*a*', 14*b*' and 14*a*", 14*b*" are generally perpendicular and portions 14*a*' and 14*b*' are generally parallel if laid flat (FIG. 3). Preferably, each opening 14*a*, 14*b* includes relatively large corner radiuses.

The openings 14 are arranged in horizontally opposed pairs of openings 14*a*, 14*b* perpendicular to the longitudinal axis A. That is, each pair of openings 14 includes a first opening 14*a* located through the front face 18 and the first side face 20 and a second opening 14*b* located through the front face 18 and the second side face 22 such that the openings 14*a*, 14*b* are aligned when viewed from one of the side faces 20, 22.

A lock opening 24 is located through the front face 18 between each vertically separated pair of openings 14*a*, 14*b*. Each lock opening 24 is displaced parallel to the longitudinal axis A and is generally square in shape. It should be understood that other shapes will also be readily usable with the present invention. Preferably, the lock opening 24 is longitudinally staggered above each pair of openings 14*a*, 14*b*.

Figure 4:
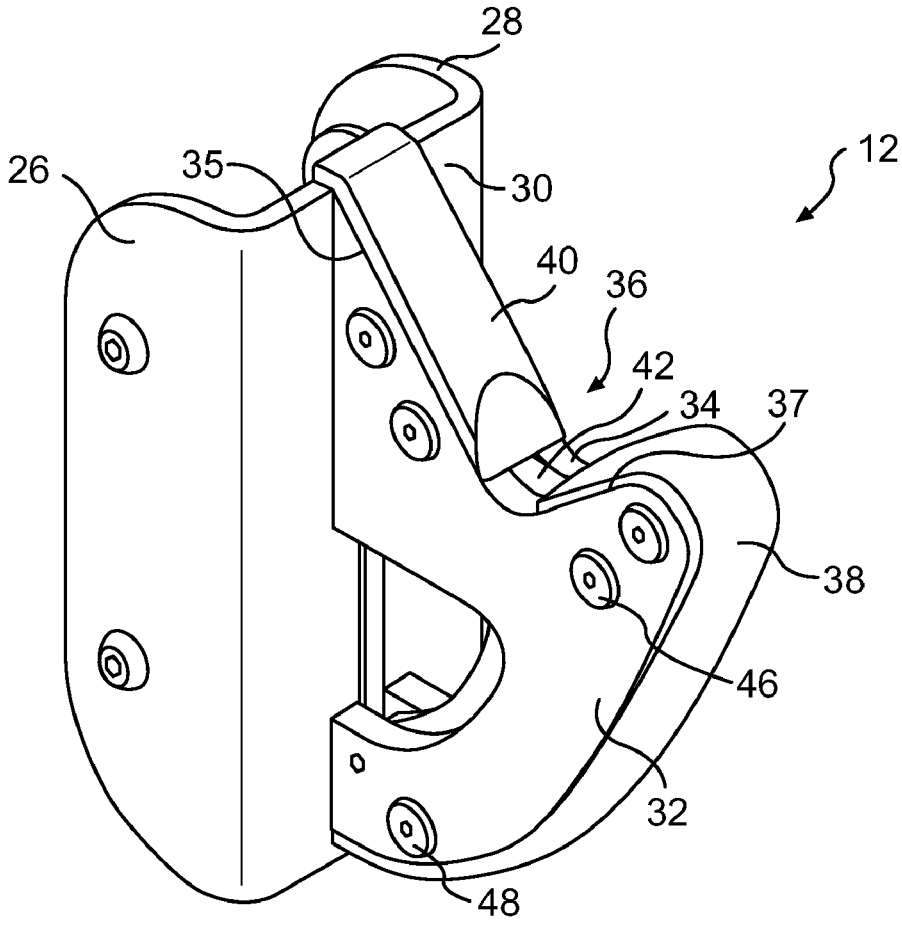
FIG. 4 is an expanded perspective view of a weight support assembly.
Figure 5:
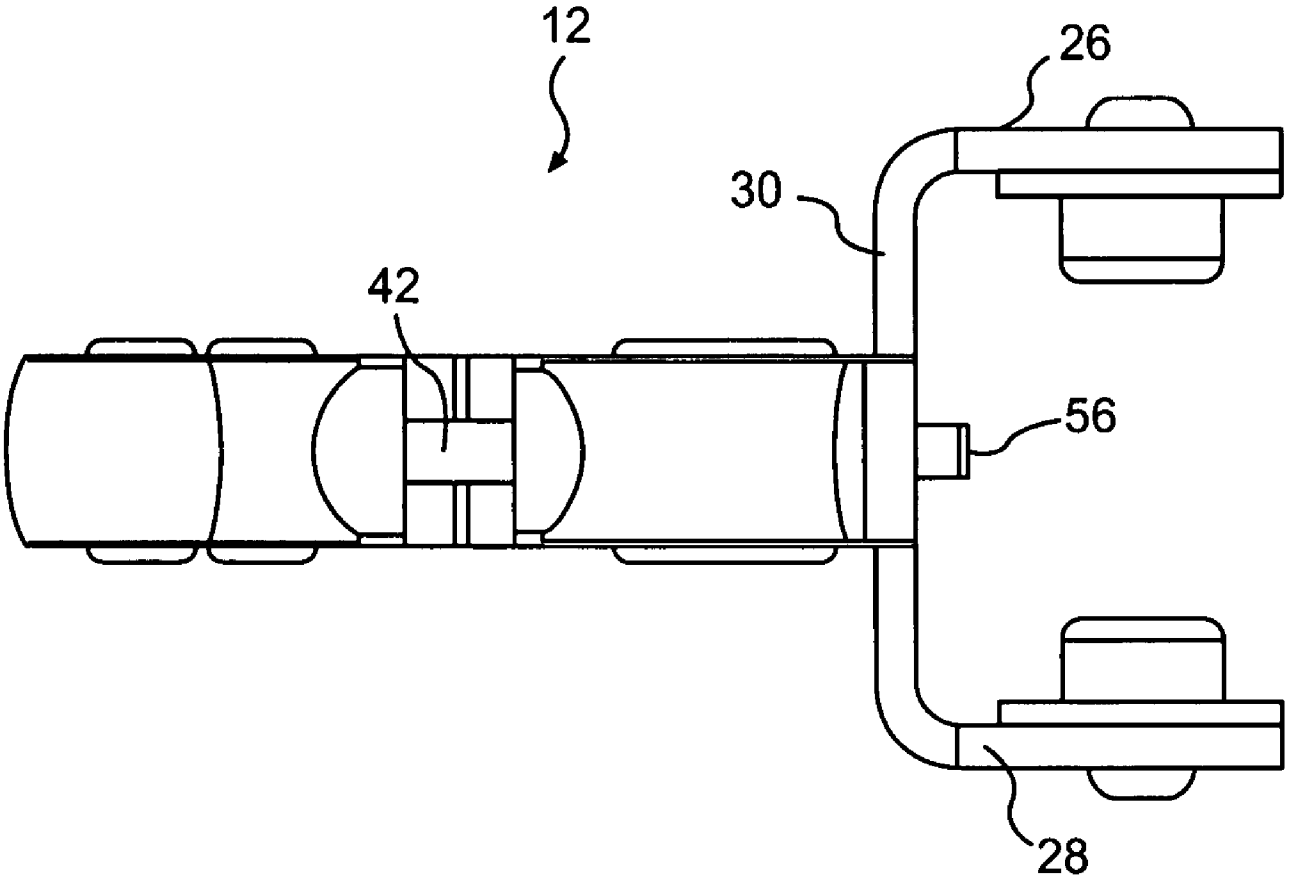
FIG. 5 is a top view of the weight support assembly.

Referring to FIG. 4, the support assembly 12 includes a first support plate 26 opposed to and generally parallel with a second support plate 28. The support plates 26, 28 extend generally perpendicularly from a central support plate 30 to form a generally U-shape (also illustrated in FIG. 5). Preferably, the support plates 26, 28 and central support plate 30 are manufactured from a single, integral U-channel member (also illustrated in FIG. 6).

Figure 6:
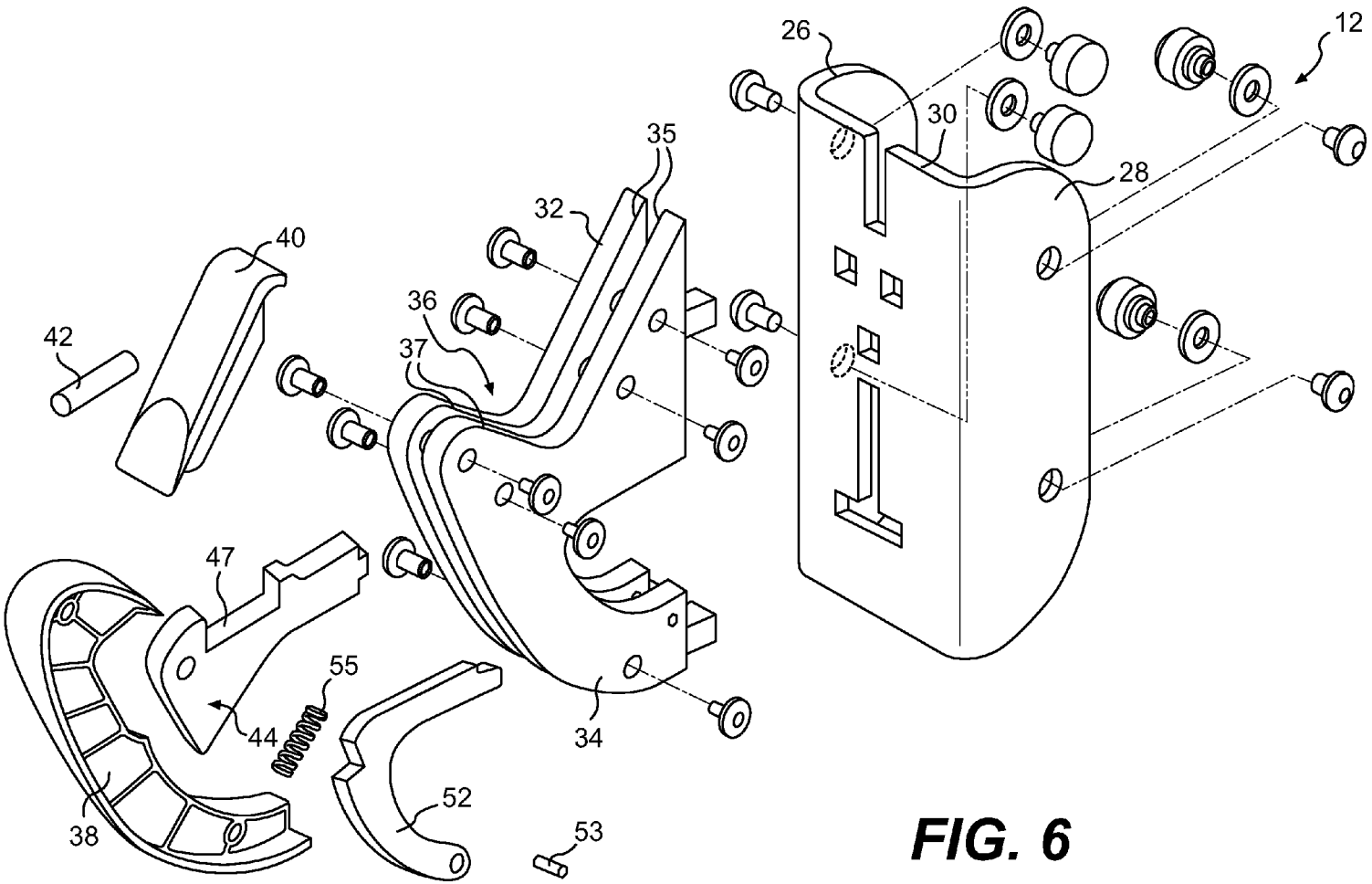
FIG. 6 is an exploded view of the weight support assembly.

A first hook plate 32 and a second hook plate 34 are generally parallel and extend perpendicularly from said central support plate 30 (also illustrated in FIG. 6). The first hook plate 32 and the second hook plate 34 are attached to the central support plate 30 through welding or the like. It should be understood that hook plates 32, 34 of various shapes will also be usable with the present invention so long as the hook plates provide an effective and secure receipt area for a weight bar or other weight lifting component.

The hook plates 32, 34 define an angled intersection 36 between a first angled surface 35 which extends at a downward angle relative to central support plate 30 and a second angled surface 37 which extends at an upward angle relative to central support plate 30 to receive a weight bar or the like at the angled intersection 36. A non-metallic bumper 38, 40 bridges an edge surface of the first hook plate 32 and the second hook plate 34 to cushion impacts with a weight bar and provide a smooth gripping surface. The non-metallic bumper 38 protects at least a portion of the second angled surface 37 and the non-metallic bumper 40 protects at least a portion of the first angled surface 35. The non-metallic bumpers 38, 40 preferably do not extend into the angled intersection as continued contact with a metal weight bar would rapidly deteriorate the non-metallic material.

Preferably, a wear pin 42 is mounted at the angled intersection 36 for rotation about a rotational axis W generally parallel to the first and second hook plates 32, 34. A pin support plate 44 (also illustrated in FIGS. 6 and 7) is preferably located between the hook plates 32, 34 to support the wear pin 42.

The pin support plate 44 is attached between the hook plates 32, 34 through welding or the like. Alternatively, or in addition thereto, a fastener 46 extends through the hook plates 32, 34 and the pin support plate 44 to further mount the pin support plate 44 therein. The pin support plate 44 receives the wear pin 42 within a recess 47 (FIG. 6). After the wear pin 42 is located within the recess 47, the non-metallic bumpers 38, 40 are installed between the hook plates 32, 34 and are attached thereto with fasteners 48 or the like.

As the non-metallic bumpers 38, 40 at least partially overlap the wear pin 42, the wear pin 42 is retained thereby. The non-metallic bumpers 38, 40 need only prevent the wear pin 42 from falling out. Notably, the wear pin 42 is supported by the pin support plate 44 such that the significant weight of the weight bar may be supported thereon. Furthermore, as the wear pin 42 is only placed within the recess 47, the wear pin 42 may rotate about axis W to facilitate positioning of the weight bar thereon. In other words, the wear pin 42 provides a rotational surface rather than a flat surface such that the weight bar is more readily longitudinally positioned than what has heretofore been conventionally available.

Figure 7:
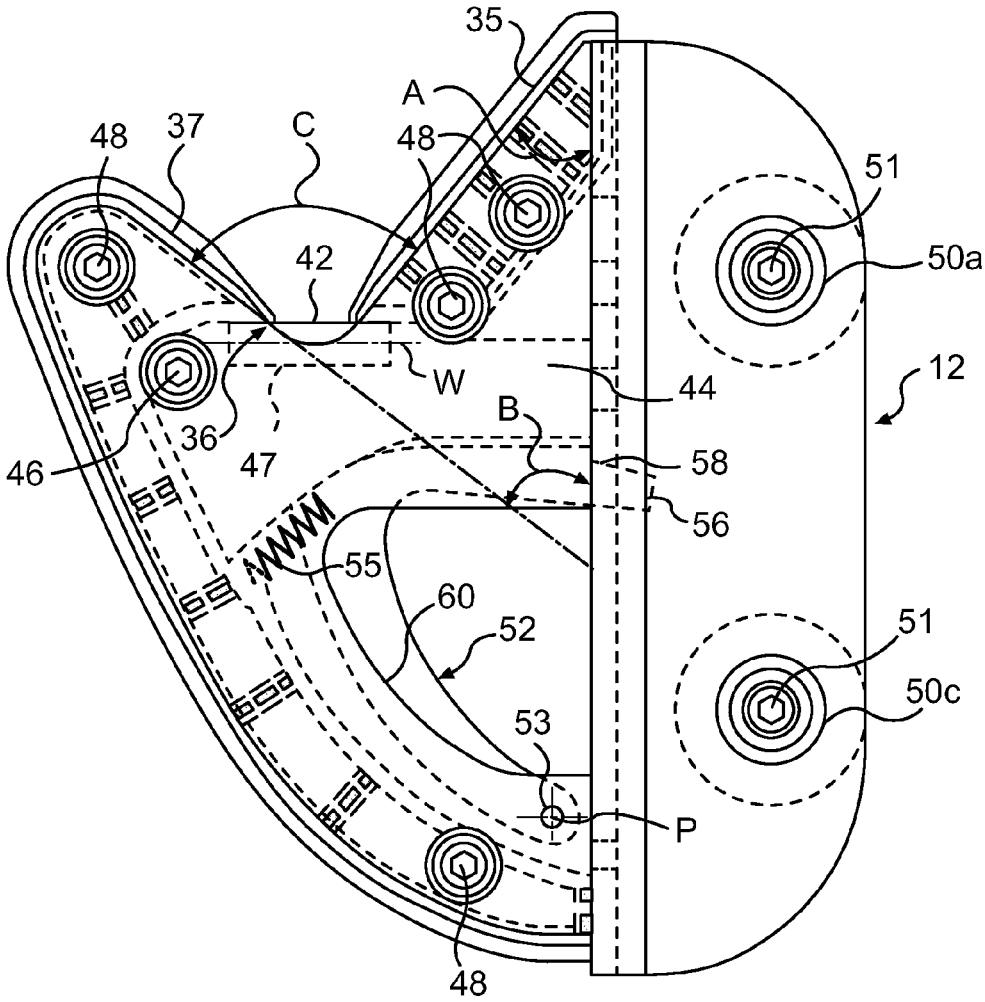
FIG. 7 is a partial phantom side view of the weight support assembly.
Figure 8:
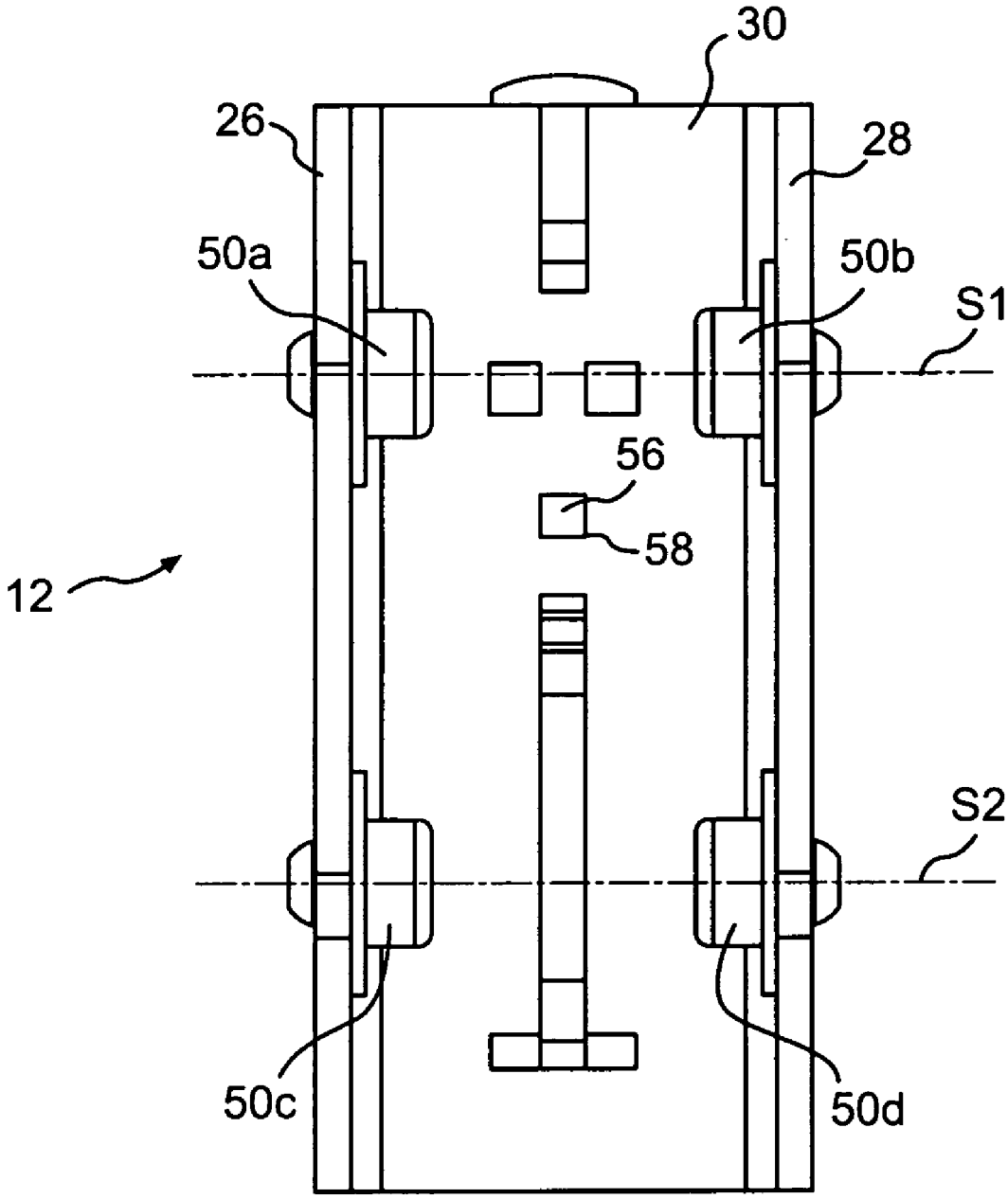
FIG. 8 is a rear view of the weight support assembly.

Referring to FIGS. 7 and 8, a first, second, third and fourth stud 50*a*-50*d* extend from an inner surface of the support plates 26, 28 to engage the openings 14 (FIG. 2). The first stud 50*a* extends from the first support plate 26 and is directly opposed to the second stud 50*b* which extends from an inner surface of the second support plate 28. The third stud 50 *c* extends from the first support plate 26 and is directly opposed to the fourth stud 50 *d* which extends from an inner surface of the second support plate 28. The first and second stud 50*a*, 50*b* are located on a common axis S1 and the third and fourth stud 50*c*, 50*d* are located along a common axis S2 (FIG. 8). The studs 50*a*-50*d* are preferably relatively significant solid members (FIG. 6) which mount through the support plates 26, 28 with fasteners 51 or the like.

Referring to FIG. 7, a lock trigger 52 is pivotally mounted between the hook plates 32, 34 at a pivot pin 53 which defines about a pivot axis P. The lock trigger 52 is biased by a spring 55 or the like such that a latch member 56 extends through a latch aperture 58 (FIG. 5) within the central support plate 30. The lock trigger 52 is accessed through a trigger guard aperture 60 formed within the hook plates 32, 34.

The first angled surface 35 in one disclosed non-limiting embodiment. defines a downward acute angle A relative to the central support plate 30. The second angled surface 37 in one disclosed non-limiting embodiment. defines an upward acute angle B relative to the central support plate 30 to receive a weight bar or the like at the angled intersection 36. That is, the downward acute angle A and the upward acute angle B define two angles of a Triangle, the apex of which is generally the angled intersection 36. The angled intersection 36 defines an approximate right angle C between the first angled surface 35 and the second angled surface 37.

In use, the weight support assembly 12 is selectively attached to a desired position along the weight bar frame rack 10 by locating the studs 50*a*-50*d* adjacent to openings 14 at a desired height. The weight support assembly 12 is pushed toward the upright frame member 16 such that the studs 50*a*-50*d* are located into the first opening portions 14' (FIG. 2). The studs 50*a*-50*d* are then guided downward by the second opening portion 14". Concurrent therewith, the lock trigger 52 is driven away from the central support plate 30 by interaction of the latch member 56 with the front face 18 of the upright frame member 16. The bias of spring 55 is overcome and the latch member 56 is retracted into the latch aperture 58. As the studs 50*a*-50*d* slide down toward the bottom of the second opening portions 14" the latch member 56 encounters the lock opening 24. When the studs 50*a*-50*d* reach the bottom of the second opening portions 14", the latch member 56 is biased into the lock opening 24 by the spring 55. The weight support assembly 12 is thereby securely locked into place. Notably, the weight support assembly 12 is supported upon the studs 50*a*-50*d* which provide an exceedingly robust support structure. The interaction between latch member 56 and lock opening 24 only locks the support assembly 12 at a desired position.

To remove the weight support assembly 12, the lock trigger 52 is retracted by grasping the hook plates 32, 34 and inserting one or more fingers into the trigger guard aperture 60. The lock trigger 52 is squeezed to overcome the bias of the spring 55 and retract the latch member 56 from the lock opening 24. The weight support assembly 12 is then lifted up and out of the openings 14. As the openings 14 include corners with significantly large radii, the studs 50*a*-50*d* are readily guided thereby. Advantageously, the entire locking and unlocking of the weight support assembly 12 is readily performed with one hand.

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A weightlifting weight support assembly removably mountable to a weight bar frame rack having an upright frame member, said weightlifting weight support assembly comprising:

a first support plate;

a second support plate generally parallel to said first support plate;

a central support plate transverse to said first support plate and said second support plate;

a first stud which extends transverse to said first support plate, said first stud engageable with a first opening at least partially through a first side face of an upright frame member;

a second stud which extends transverse to said second support plate, said second stud facing toward said first stud, said second stud engageable with a second opening at least partially through a second side face of said upright frame member;

a first hook plate which extends from said central support plate, said first hook plate defines a first angled surface which extends at a downward angle relative to said central support plate and a second angled surface which extends at an upward angle relative to said central support plate to define an angled intersection operable to receive a weight bar;

a second hook plate which extends from said central support plate, said second hook plate generally parallel to said second hook plate, said first hook plate defines a first angled surface which extends at a downward angle relative to said central support plate and a second angled surface which extends at an upward angle relative to said central support plate to define an angled intersection operable to receive a weight bar; and a lock trigger pivotally mounted between said first hook plate and said second hook plate, said lock trigger biased such that a latch member of said lock trigger is extendable through a latch aperture within said central support plate to engage a lock opening at least partially through a front face of said upright frame member, said front face between said first side face and said second side face.

2. The weightlifting support assembly as recited in claim 1, wherein said first stud and said second stud are defined along a first stud axis.

3. The weightlifting support assembly as recited in claim 2, further comprising:

a third stud which extends from said first support plate; and a fourth stud which extends from said second support plate, said fourth stud facing toward said third stud.

4. The weightlifting support assembly as recited in claim 3, wherein said third stud and said fourth stud are defined along a second stud axis generally parallel to said first stud axis.

5. The weightlifting support assembly as recited in claim 4, wherein said first stud, said second stud, said third stud and said fourth stud are generally cylindrical.

6. The weightlifting support assembly as recited in claim 1, wherein said first support plate, said second support plate and said central support plate form a generally U-shape.

7. The weightlifting support assembly as recited in claim 1, further comprising a wear pin between said first hook plate and said second hook plate.

8. The weightlifting support assembly as recited in claim 7, wherein said wear pin rotates about an axis generally parallel to said first hook plate and said second hook plate.

9. The weightlifting support assembly as recited in claim 7, wherein said wear pin is located at an angled intersection formed in said first hook plate and said second hook plate.

10. The weightlifting support assembly as recited in claim 9, further comprising a non-metallic bumper which bridges an edge surface between said first hook plate and said second hook plate, said wear pin at least partially exposed through said non-metallic bumper.

11. The weightlifting support assembly as recited in claim 1, further comprising a non-metallic bumper which bridges an edge surface between said first hook plate and said second hook plate.

12. The weightlifting support assembly as recited in claim 1, wherein said lock trigger is pivotable about a pivot axis relative said first hook plate and said second hook plate.

13. The weightlifting support assembly as recited in claim 1, wherein said lock trigger is spring biased to maintain said lock member extended through said central support plate and said lock opening.

14. The weightlifting support assembly as recited in claim 1, wherein said lock trigger is accessible through a trigger guard aperture formed by said first hook plate and said second hook plate.

15. The weightlifting support assembly as recited in claim 1, wherein said first support plate, said second support plate and said central support plate are manufactured from a single, integral U-channel member.

16. A weightlifting weight support assembly removably mountable to a weight bar frame rack having an upright frame member, said weightlifting weight support assembly comprising:

a first support plate;

a second support plate generally parallel to said first support plate;

a central support plate, said first support plate and said second support plate extend from said central support plate to form a generally U-shape;

a first stud which extends transverse to said first support plate, said first stud engageable with a first opening at least partially through a first side face of an upright frame member;

a second stud which extends transverse to said second support plate, said second stud facing toward said first stud, said second stud engageable with a second opening at least partially through a second side face of said upright frame member;

a first hook plate and a second hook plate which extend from said central support plate, said first hook plate generally parallel to said second hook plate, said first hook plate and said second hook plate each define a first angled surface which extends at a downward angle relative to said central support plate and a second angled surface which extends at an upward angle relative to said central support plate to define an angled intersection operable to receive a weight bar; and a wear pin between said first hook plate and said second hook plate, said wear pin located at said angled intersection between said first hook plate and a second hook plate such that said wear pin is rotatable about an axis generally parallel to said first hook plate and said second hook plate.

17. A weightlifting weight support assembly removably mountable to a weight bar frame rack having an upright frame member, said weightlifting weight support assembly comprising:

a first support plate;

a second support plate generally parallel to said first support plate;

a central support plate, said first support plate and said second support plate extend from said central support plate to form a generally U-shape;

a first stud which extends transverse to said first support plate, said first stud engageable with a first opening at least partially through a first side face of an upright frame member;

a second stud which extends transverse to said second support plate, said second stud facing toward said first stud, said second stud engageable with a second opening at least partially through a second side face of said upright frame member;

a first hook plate and a second hook plate which extend from said central support plate, said first hook plate generally parallel to said second hook plate, said first hook plate and said second hook plate each define a first angled surface which extends at a downward angle relative to said central support plate and a second angled surface which extends at an upward angle relative to said central support plate to define an angled intersection operable to receive a weight bar; and a non-metallic bumper which bridges an edge surface between said first hook plate and said second hook plate.

18. A weightlifting weight support assembly removably mountable to a weight bar frame rack having an upright frame member, said weightlifting weight support assembly comprising:

a first support plate;

a second support plate generally parallel to said first support plate;

a central support plate transverse to said first support plate and said second support plate;

a first stud which extends transverse to said first support plate, said first stud engageable with a first opening at least partially through a first side face of an upright frame member;

a second stud which extends transverse to said second support plate, said second stud facing toward said first stud such that said first stud and said second stud defined along a first stud axis, said second stud engageable with a second opening at least partially through a second side face of said upright frame member;

a third stud which extends transverse to said first support plate, said third stud engageable with a third opening at least partially through said first side face of said upright frame member;

a fourth stud which extends transverse to said second support plate, said fourth stud facing toward said third stud such that said third stud and said fourth stud are defined along a second stud axis generally parallel to said first stud axis, said first stud, said second stud, said third stud and said fourth stud define a stud plane, said stud plane substantially parallel to said central support plate, said fourth stud engageable with a fourth opening at least partially through said second side face of said upright frame member; and a first hook plate which extends from said central support plate, said first hook plate defines a first angled surface which extends at a downward angle relative to said central support plate and a second angled surface which extends at an upward angle relative to said central support plate to define an angled intersection operable to receive a weight bar.

19. The weightlifting support assembly as recited in claim 18, wherein said first stud, said second stud, said third stud and said fourth stud are generally cylindrical.

20. A weightlifting weight support assembly removably mountable to a weight bar frame rack having an upright frame member, said weightlifting weight support assembly comprising:

a first support plate;

a second support plate generally parallel to said first support plate;

a central support plate transverse to said first support plate and said second support plate;

a first stud which extends transverse to said first support plate, said first stud engageable with a first opening at least partially through a first side face of an upright frame member;

a second stud which extends transverse to said second support plate, said second stud facing toward said first stud, said second stud engageable with a second opening at least partially through a second side face of said upright frame member;

a first hook plate which extends from said central support plate, said first hook plate defines a first angled surface which extends at a downward angle relative to said central support plate and a second angled surface which extends at an upward angle relative to said central support plate to define an angled intersection operable to receive a weight bar.

21. The weightlifting support assembly as recited in claim 20, wherein said first stud and said second stud are defined along a first stud axis.

22. The weightlifting support assembly as recited in claim 21, further comprising:

a third stud which extends from said first support plate; and a fourth stud which extends from said second support plate, said fourth stud facing toward said third stud.

23. The weightlifting support assembly as recited in claim 22, wherein said third stud and said fourth stud are defined along a second stud axis generally parallel to said first stud axis.

24. The weightlifting support assembly as recited in claim 23, wherein said first stud, said second stud, said third stud and said fourth stud are generally cylindrical.

25. The weightlifting support assembly as recited in claim 22, wherein said first stud, said second stud, said third stud and said fourth stud are generally cylindrical.

26. The weightlifting support assembly as recited in claim 20, further comprising a latch member operable to engage a lock opening formed through a front face of the upright frame member, the front face generally parallel to said central support plate.

27. The weightlifting support assembly as recited in claim 26, further comprising a lock trigger to operate said latch member.

28. The weightlifting support assembly as recited in claim 20, further comprising a non-metallic bumper which at least partially covers said first angled surface.

29. The weightlifting support assembly as recited in claim 20, further comprising a non-metallic bumper which at least partially covers said second angled surface.

30. The weightlifting support assembly as recited in claim 20, wherein said downward angle defines a downward acute angle relative to said central support plate.

31. The weightlifting support assembly as recited in claim 20, wherein said upward angle defines an upward acute angle relative to said central support plate.

32. The weightlifting support assembly as recited in claim 20, wherein said downward angle defines a downward acute angle relative to said central support plate and said upward angle defines an upward acute angle relative to said central support plate, said first angled surface and said second angled surface defines an angled intersection.

33. The weightlifting support assembly as recited in claim 32, wherein said angled intersection defines an approximate right angle between said first angled surface and said second angled surface.

34. The weightlifting support assembly as recited in claim 32, wherein said angled intersection defines an approximate right angle between said first angled surface and said second angled surface.

35. The weightlifting support assembly as recited in claim 20, wherein said first support plate, said second support plate and said central support plate form a generally U-shape.

36. The weightlifting support assembly as recited in claim 20, wherein said first angled surface is fixed relative to said second angled surface.

* * * * *